US008381406B2

(12) United States Patent
Miyazaki

(10) Patent No.: US 8,381,406 B2
(45) Date of Patent: Feb. 26, 2013

(54) REPLACEMENT BLADE RAZOR

(75) Inventor: Hiroaki Miyazaki, Seki (JP)

(73) Assignee: Kai R&D Center Co., Ltd., Gifu-ken (JP)

( * ) Notice: Subject to any disclaimer, the term of this patent is extended or adjusted under 35 U.S.C. 154(b) by 523 days.

(21) Appl. No.: 12/591,851

(22) Filed: Dec. 3, 2009

(65) Prior Publication Data

US 2010/0139103 A1 Jun. 10, 2010

(30) Foreign Application Priority Data

Dec. 5, 2008 (JP) ..... 2008-310514

(51) Int. Cl.
*B26B 21/08* (2006.01)

(52) U.S. Cl. ..... 30/51; 30/58; 30/74; 30/84

(58) Field of Classification Search ..... 30/47, 50–84, 30/527–533
See application file for complete search history.

(56) References Cited

U.S. PATENT DOCUMENTS

| | | | | | |
|---|---|---|---|---|---|
| 2,162,388 | A * | 6/1939 | Rockwell | 30/531 |
| 2,683,929 | A * | 7/1954 | Auerbach | 30/74.1 |
| 2,793,431 | A * | 5/1957 | Fortin | 30/59 |
| 2,885,778 | A * | 5/1959 | Randol | 30/74 |
| 2,886,888 | A * | 5/1959 | Fiske | 30/58 |
| 2,911,712 | A * | 11/1959 | Choclin et al. | 30/58 |
| 3,581,393 | A * | 6/1971 | Yager | 30/61 |
| 3,644,992 | A * | 2/1972 | Bennett et al. | 30/64 |
| 3,646,674 | A * | 3/1972 | Fitzpatrick | 30/64 |
| 3,650,027 | A * | 3/1972 | Stephenson et al. | 30/58 |
| 3,660,894 | A * | 5/1972 | Sand | 30/74 |
| 3,708,879 | A * | 1/1973 | Stephenson et al. | 30/61 |
| 3,740,841 | A * | 6/1973 | Risher | 30/63 |
| 3,972,115 | A * | 8/1976 | Ross | 30/59 |
| 4,059,891 | A * | 11/1977 | Panagiotoulis | 30/50 |
| 4,180,907 | A * | 1/1980 | Iten | 30/64 |
| 4,241,501 | A * | 12/1980 | Westlake, Jr. | 30/59 |
| 4,485,554 | A * | 12/1984 | Bergamaschi | 30/50 |
| 4,715,120 | A * | 12/1987 | McGready | 30/57 |
| 4,813,131 | A * | 3/1989 | Gruner | 30/50 |
| 4,860,449 | A * | 8/1989 | Duncan | 30/47 |
| 5,012,578 | A * | 5/1991 | Siefer | 30/84 |
| 5,551,153 | A * | 9/1996 | Simms | 30/41 |
| 5,848,475 | A * | 12/1998 | Hill et al. | 30/527 |
| 6,425,184 | B1 * | 7/2002 | Min | 30/527 |
| 6,557,265 | B2 * | 5/2003 | Coffin | 30/532 |
| 6,671,961 | B1 * | 1/2004 | Santhagens Van Eibergen et al. | 30/50 |
| 6,877,227 | B2 * | 4/2005 | Santhagens Van Eibergen et al. | 30/50 |
| 6,990,740 | B2 * | 1/2006 | Follo et al. | 30/532 |
| 7,178,241 | B1 * | 2/2007 | Cummings et al. | 30/41 |
| 7,992,304 | B2 * | 8/2011 | Nakasuka | 30/50 |
| 8,046,920 | B2 * | 11/2011 | Nakasuka | 30/50 |
| 8,104,179 | B2 * | 1/2012 | Nakasuka | 30/50 |
| 2004/0181953 | A1 * | 9/2004 | Follo et al. | 30/527 |
| 2006/0248726 | A1 * | 11/2006 | Coffin | 30/50 |
| 2008/0256800 | A1 * | 10/2008 | Nicoll | 30/50 |
| 2012/0096722 | A1 * | 4/2012 | Howell et al. | 30/531 |
| 2012/0096723 | A1 * | 4/2012 | Howell et al. | 30/531 |
| 2012/0210586 | A1 * | 8/2012 | Lelieveld et al. | 30/527 |

FOREIGN PATENT DOCUMENTS

| | | |
|---|---|---|
| JP | U-33-19065 | 11/1958 |
| JP | U-36-18544 | 7/1961 |

(Continued)

*Primary Examiner* — Jason Daniel Prone
(74) *Attorney, Agent, or Firm* — Posz Law Group, PLC

(57) ABSTRACT

A replacement blade razor including a holder having a head portion, a razor head supported by the head portion of the holder, and a blade member removably mounted in the razor head is provided. The head portion of the holder or the razor head includes a holding mechanism that assists in mounting of the blade member in the razor head by attracting or adhering to the blade member and thus causing the razor head to hold the blade member.

28 Claims, 9 Drawing Sheets

FOREIGN PATENT DOCUMENTS

| | | | |
|---|---|---|---|
| JP | U-40-25076 | | 8/1965 |
| JP | U-43-3396 | | 2/1968 |
| JP | A-55-30450 | | 7/1980 |
| JP | U-58-16385 | | 4/1983 |
| JP | U-2-14761 | | 4/1990 |
| JP | A-06-105971 | | 4/1994 |
| JP | A-08-168580 | | 7/1996 |
| JP | B2-2846253 | | 10/1998 |
| JP | A-2007-215590 | | 8/2007 |
| JP | 2010131228 | A * | 6/2010 |

* cited by examiner 1
2
3
3a
5
6a
12
13
14
15
16
16a
27
31a 2
3
3a
6a
8
9
11
12
13
14
15
16
16a
19
27
31a
32
33
5

REPLACEMENT BLADE RAZOR

BACKGROUND OF THE INVENTION

The present invention relates to a replacement blade razor in which a razor head is supported by the head portion of a holder.

Japanese Examined Utility Model Publication No. 55-30450 discloses a razor in which a blade member illustrated in FIG. 2 is mounted in the head portion of a holder illustrated in FIG. 1. The blade member includes upper and lower blades (4, 5) and a spacer (1) arranged between the blades. The head of the holder has a clearance defined by a lower plate (14) and an upper plate (17). The blade member is received in the clearance and supported by the holder. To mount the blade member in the head of the holder, the blade member must be touched directly by hand.

Japanese Laid-Open Patent Publication No. 2007-215590 discloses a razor in which a razor head with a blade member is supported removably and pivotally by two support arms provided in the head portion of a holder. In the case of this razor, the blade member cannot be replaced independently but must be replaced together with the razor head.

SUMMARY OF THE INVENTION

Accordingly, it is an objective of the present invention to provide a replacement blade razor that allows a blade member to be mounted in a razor head without being touched directly by hand. It is another objective of the invention to provide a replacement blade razor that allows a blade member to be replaced independently from a pivotable razor head.

To achieve the foregoing objective and in accordance with a first aspect of the present invention, a replacement blade razor including a holder having a head portion, a razor head supported by the head portion of the holder, and a blade member removably mounted in the razor head is provided. The head portion of the holder or the razor head includes a holding mechanism that assists in mounting of the blade member in the razor head by attracting or adhering to the blade member and thus causing the razor head to hold the blade member.

In accordance with a second aspect of the present invention, a replacement blade razor including a holder having a head portion, a razor head supported by the head portion of the holder, a blade member removably mounted in the razor head, and a loading member used to mount the blade member in the razor head is provided. The loading member is capable of holding the blade member and loading the blade member held by the loading member to the razor head.

In accordance with a third aspect of the present invention, a replacement blade razor including a holder having a head portion, a razor head supported by the head portion of the holder, and a blade member removably mounted in the razor head. The razor head includes a blade receiving member and a lid member supported by the blade receiving member. The blade member is mounted in the razor head while being placed on the blade receiving member and held, in this state, by the lid member. The razor head is configured to be switched between a first state in which the razor head is allowed to pivot while holding, by the lid member, the blade member placed on the blade receiving member and a second state in which the razor head allows the blade member to be removed through separation of the lid member from the blade receiving member.

In accordance with a fourth aspect of the present invention, a replacement blade razor including a holder having a head portion, a razor head supported by the head portion of the holder, and a blade member removably mounted in the razor head is provided. The razor head includes a blade receiving member and a lid member supported by the blade receiving member. The blade member is mounted in the razor head while being placed on the blade receiving member and held, in this state, by the lid member. The razor head is configured to be switched among a first state in which the razor head is allowed to pivot while holding, by the lid member, the blade member placed on the blade receiving member, a second state in which the razor head is prevented from pivoting while holding, by the lid member, the blade member placed on the blade receiving member, and a third state in which the razor head allows the blade member to be removed through separation of the lid member from the blade receiving member.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

Figure 7B:
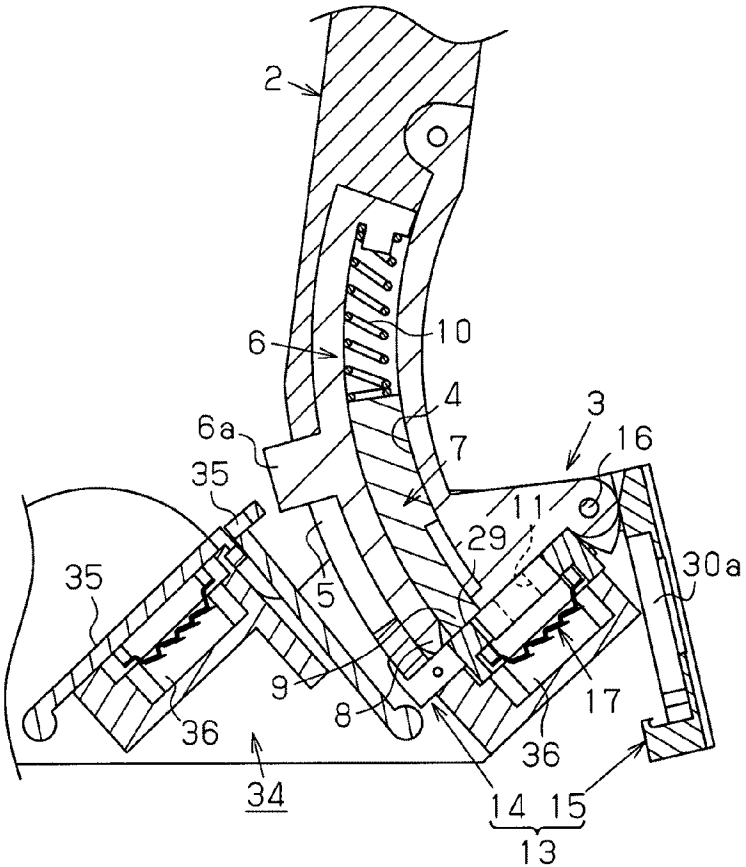
FIGS. 7A and 7B are cross-sectional views illustrating a method of mounting a replacement blade assembly accommodated in the replacement blade case illustrated in FIGS. 6A and 6B in the razor of FIGS. 1A to 2A.
Figure 7A:
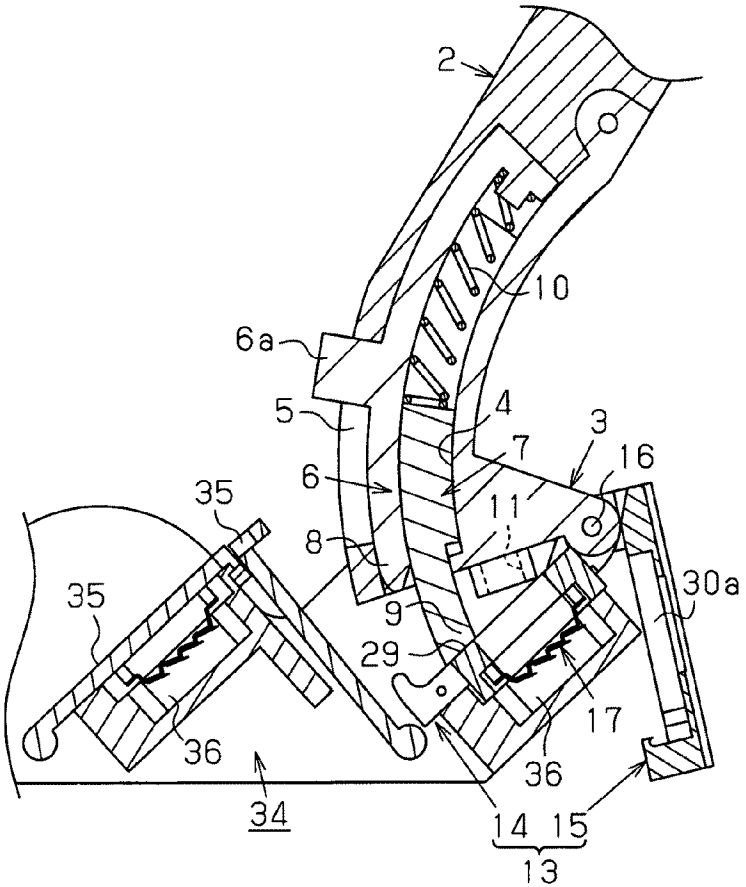
Figure 10A:
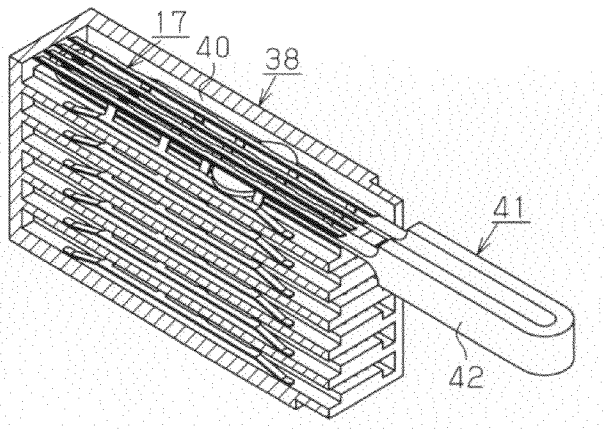
Figure 10B:
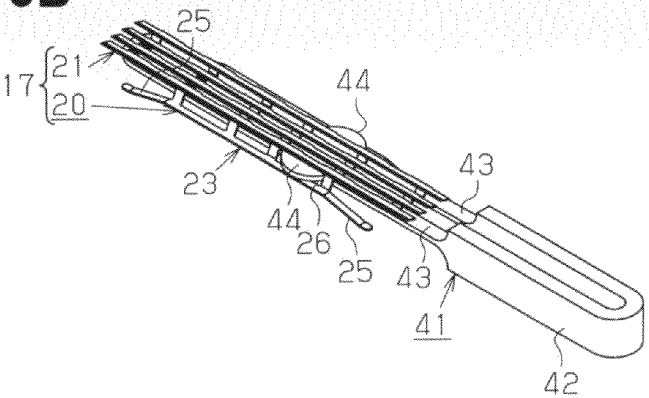
Figure 9A:
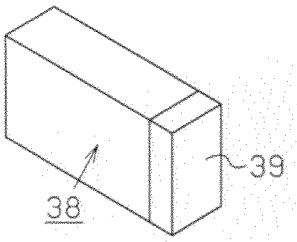
Figure 9B:
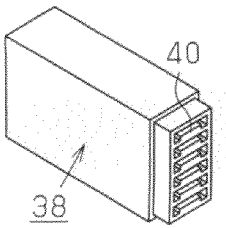
Figure 9C:
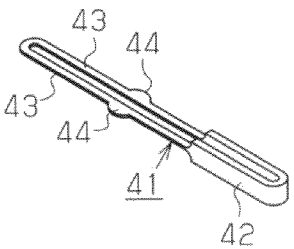
Figure 11A:
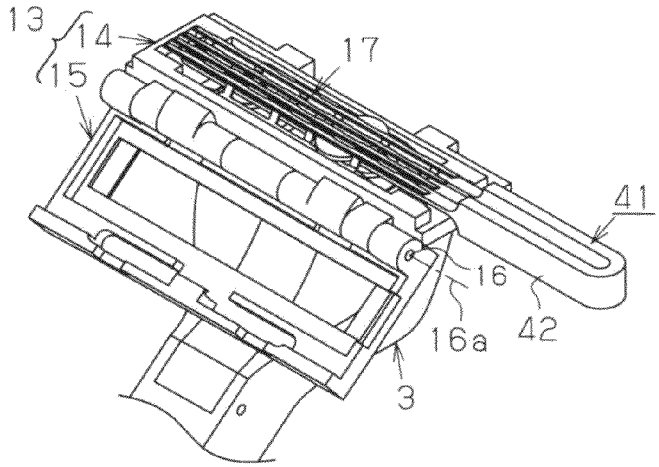
Figure 11B:
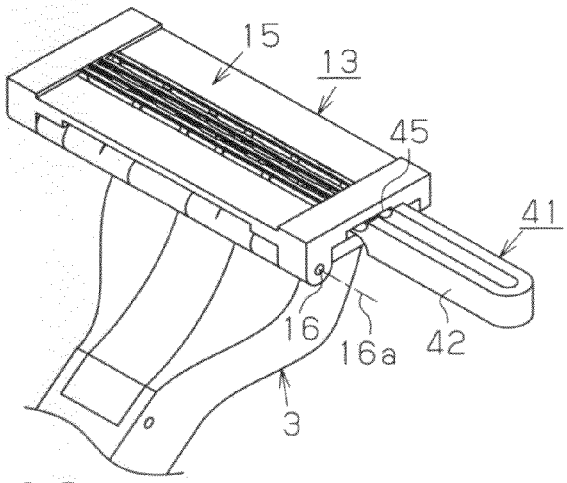
Figure 11C:
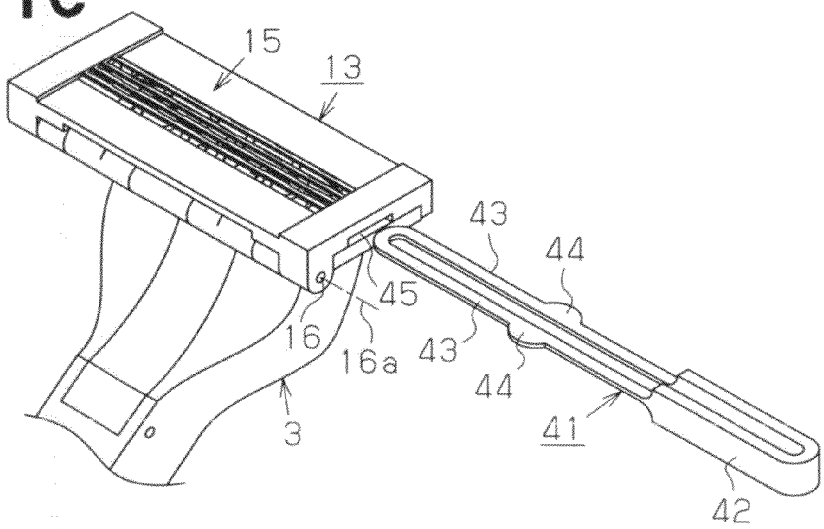

1A to 2A in a state immediately after the replacement blade assembly has been mounted by the method illustrated in FIGS. 7A and 7B;

FIGS. 9A and 9B are perspective views showing a replacement blade case that accommodates the replacement blade assemblies used in the second embodiment of the present invention;

FIG. 9C is a perspective view showing a loading member employed to mount a replacement blade assembly accommodated in the replacement blade case illustrated in FIGS. 9A and 9B in the razor;

FIG. 10A and FIG. 10B are a partially cutaway perspective view and a perspective view, illustrating a method of separating a replacement blade assembly from the replacement blade case using the loading member shown in FIG. 9C; and FIGS. 11A, 11B, and 11C are perspective views illustrating a method of mounting a replacement blade assembly in the razor using the loading member illustrated in FIG. 9C.

DETAILED DESCRIPTION OF THE PREFERRED EMBODIMENTS

A first embodiment of the present invention will now be described with reference to FIGS. 1A to 2A and FIGS. 3A to 8B.

Figures 1A, 1B, 1C:
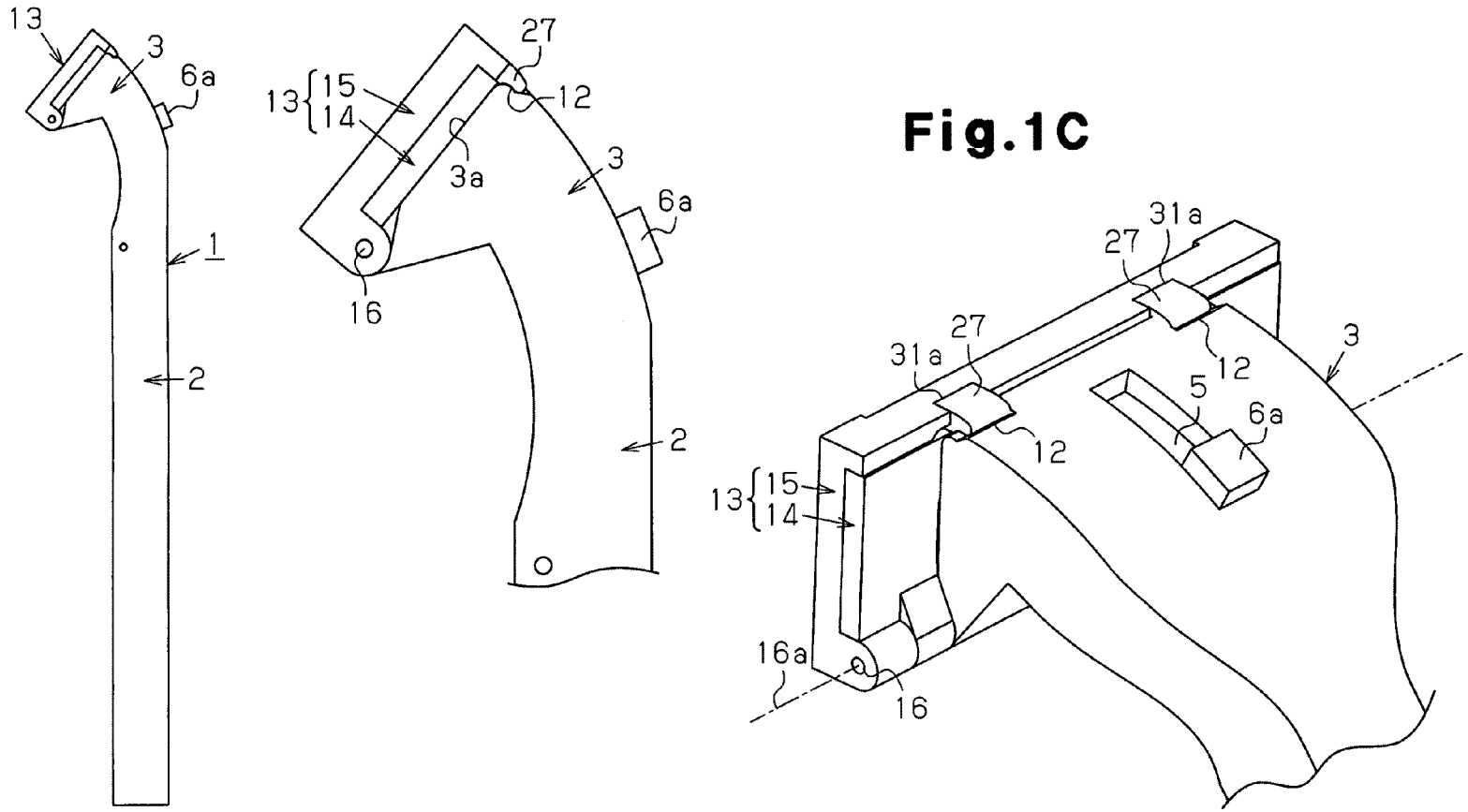
FIG. 1A is a side view showing a replacement blade razor according to a first embodiment of the present invention in a non-pivotable state.
FIG. 1B is a side view showing a portion of the razor illustrated in FIG. 1A in the non-pivotable state.
FIG. 1C is a perspective view showing a portion of the razor illustrated in FIG. 1A in the non-pivotable state.

As shown in FIG. 1A, a replacement blade razor according to the first embodiment has a holder 1 and a razor head 13. The holder 1 includes an elongated holding portion 2 and a head portion 3, which is formed integrally with the holding portion 2 at the upper end of the holding portion 2.

Figure 2B:
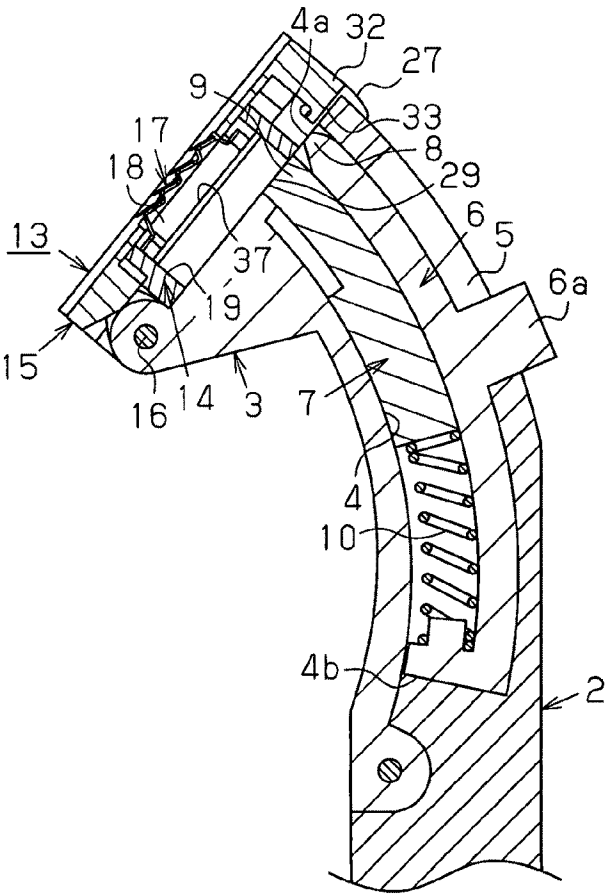
FIG. 2B is a partial cross-sectional side view showing a replacement blade razor according to a modification of the first embodiment in a non-pivotable state.
Figure 2A:
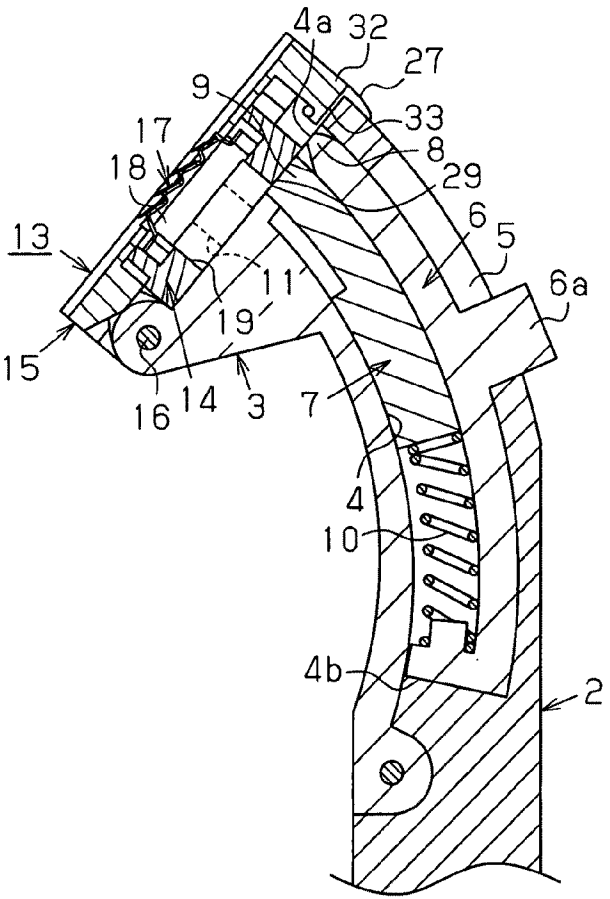
FIG. 2A is a partial cross-sectional side view showing the razor illustrated in FIG. 1A in the non-pivotable state.

As illustrated in FIG. 2A, an elongated hollow space 4, which extends from the upper end of the holding portion 2 to the holder head portion 3, is formed in the holder 1. The hollow space 4 has an opening 4*a* formed at a front end surface 3*a* (see FIG. 1B) of the holder head portion 3. A manipulation hole 5 (see FIG. 1C), which communicates with the hollow space 4 of the holder 1 and has an opening facing diagonally upward, is formed in the holder head portion 3. The hollow space 4 of the holder 1 receives a manipulation member 6, a pusher 7, and a spring 10 such as a compression spring. The manipulation member 6 includes a knob 6*a*, which projects toward the exterior through the manipulation hole 5. The manipulation member 6 and the pusher 7 have a pressing portion 8 and a pressing portion 9, respectively, which are located at positions corresponding to the opening 4*a* of the hollow space 4. The spring 10, which is arranged between the manipulation member 6 and the pusher 7, urges the pusher 7 in the hollow space 4 toward the opening 4*a* of the hollow space 4. The spring 10 also urges the manipulation member 6 in the hollow space 4 in the direction opposed to the opening 4*a*, or, in other words, toward a bottom 4*b* of the hollow space 4.

Permanent magnets 11, which are located at the left and right sides of the opening 4*a* of the hollow space 4, project from the front end surface 3*a* of the holder head portion 3. There is a clearance of approximately 18 mm between the left and right permanent magnets 11. The material forming the holder head portion 3 covers a peripheral portion of each of the permanent magnets 11 but not the top surfaces of the permanent magnets 11. Left and right engagement recesses 12 (see FIG. 1C), which are located above the opening 4*a* of the hollow space 4, are formed in the holder head portion 3. With reference to FIG. 1C, the manipulation hole 5 is located substantially at a middle position between the engagement recesses 12.

As shown in FIGS. 1B and 1C, the razor head 13 includes a blade receiving member 14 facing the holder head portion 3 and a lid member 15, which is supported by the blade receiving member 14. The razor head 13 is supported by the holder head portion 3 in a manner pivotable with respect to the holder head portion 3. Specifically, the blade receiving member 14 is supported by the holder head portion 3 in a swinging manner. A blade member is formed of magnetic material such as metal, and is placed on the blade receiving member 14. The lid member 15 holds the blade member to the blade receiving member 14. The blade member is a blade assembly 17 (see FIGS. 5A and 5B) in this embodiment. With reference to FIGS. 3A to 4C, the blade receiving member 14 and the lid member 15 of the razor head 13 are pivotable independently or integrally about a common support shaft 16 located below the opening 4*a* of the hollow space 4, which is, in other words, a common pivot axis 16*a*.

Figure 4A:
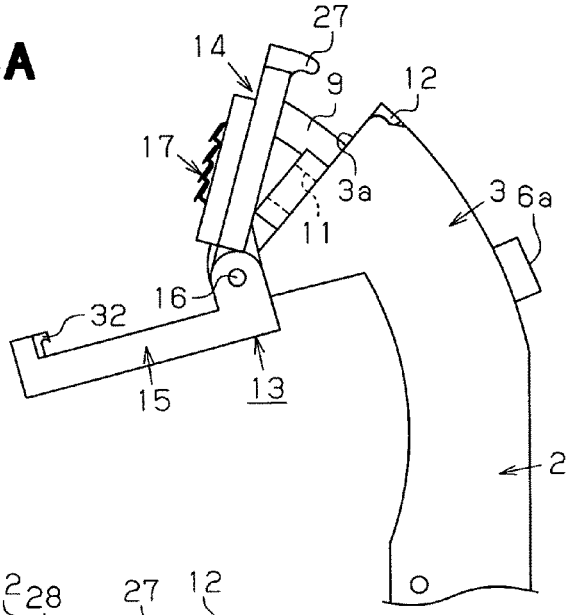
FIG. 4A is a side view showing a portion of the razor illustrated in FIGS. 1A to 2A in the blade assembly replaceable state.
Figure 4B:
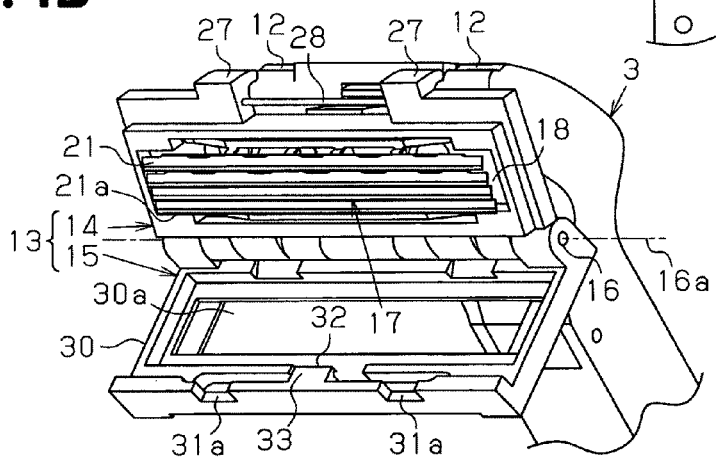
FIG. 4B is a perspective view showing a portion of the razor illustrated in FIGS. 1A to 2A in the blade assembly replaceable state.
Figure 4C:
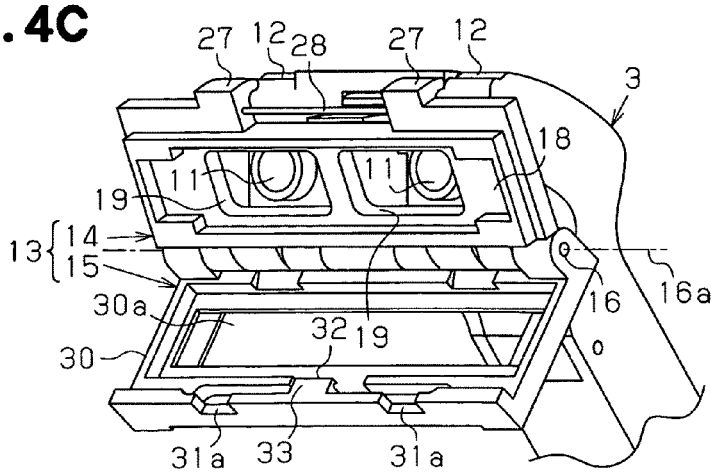
FIG. 4C is a perspective view showing a portion of the razor illustrated in FIGS. 1A to 2A after a blade assembly is removed in the blade assembly replaceable state.

As shown in FIG. 4C, a recess 18 is formed in the blade receiving member 14. The blade assembly 17 is fitted into the recess 18. Left and right through holes 19 are formed in the bottom of the recess 18. Each one of the through holes 19 corresponds to one of the permanent magnets 11. Accordingly, when the blade assembly 17 is fitted in the recess 18 of the blade receiving member 14, the blade assembly 17 is attracted to the permanent magnets 11 through the through holes 19 by magnetic force.

Figure 5A:
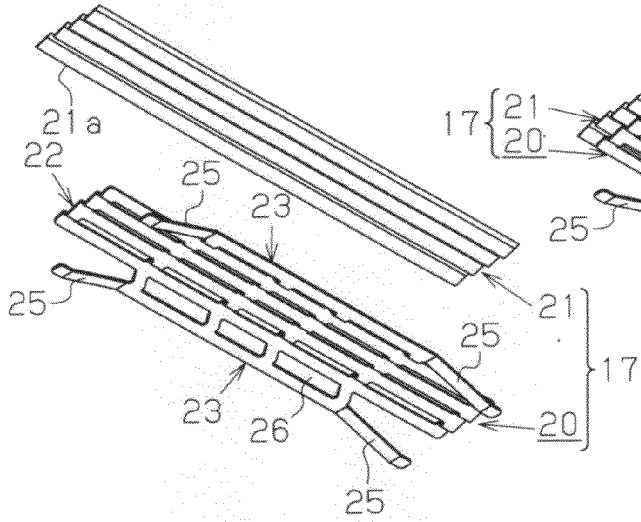
FIG. 5A is an exploded perspective view showing the blade assembly of the razor illustrated in FIGS. 1A to 2A.
Figure 5B:
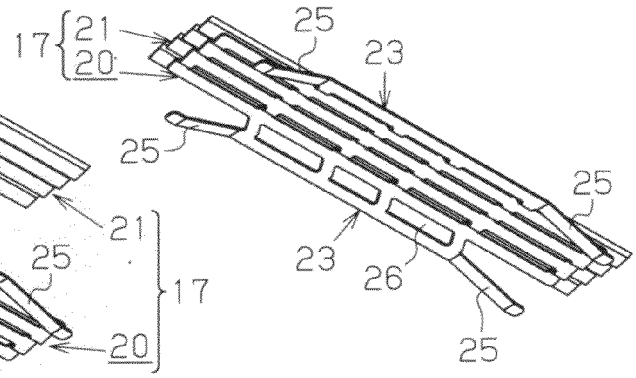
FIG. 5B is a perspective view showing the blade assembly illustrated in FIG. 5A in an assembled state.

As shown in FIGS. 5A and 5B, the blade assembly 17 includes a seat 20 and a plurality of (for example, four) blades 21. The seat 20 has a corrugated plate portion 22 and a pair of leg portions 23 extending from both ends of the corrugated plate portion 22 in its transverse direction. The blades 21 are spot-welded onto the corrugated plate portion 22 while being aligned along the transverse direction of the corrugated plate portion 22. Each of the leg portions 23 has a pair of leaf springs 25 and a plurality of engagement holes 26, which are aligned in the longitudinal direction of the corrugated plate portion 22.

When the blade assembly 17 is fitted in the recess 18 of the blade receiving member 14, the leaf springs 25 of the leg portions 23 are held in contact with the bottom of the recess 18, and the blades 21 on the corrugated plate portion 22 face the lid member 15. Accordingly, in correspondence with elastic deformation of the leaf springs 25 of the leg portions 23, the blades 21 mounted on the corrugated plate portion 22 are capable of approaching the bottom of the recess 18. The permanent magnets 11 of the holder head portion 3 face the backside of the corrugated plate portion 22 through the corresponding through holes 19.

As shown in FIG. 1C, engagement claws 27, which are selectively engaged with and disengaged from the corresponding engagement recesses 12 of the holder head portion 3, are formed at the left and right sides of the upper end of the blade receiving member 14, which are, in other words, the left and right sides of one end of the blade receiving member 14 in its transverse direction opposite to the end in which the support shaft 16 is located. With reference to FIGS. 4B and 4C, an engagement shaft 28, which is arranged between the two engagement claws 27, is formed at the upper end of the blade receiving member 14. A pressure receiving surface 29 illustrated in FIG. 2A, which is the portion of the blade receiving member 14 held in contact with the pressing portion 9 of the pusher 7, is located below the engagement shaft 28.

As shown in FIGS. 4B and 4C, the lid member 15 has a frame body 30 having a window hole 30*a*, from which the blades 21 of the blade assembly 17 fitted in the recess 18 of the blade receiving member 14 are exposed to the exterior. Recesses 31*a* are formed at the left and right sides of the upper end of the frame body 30, which are, in other words, the left and right sides of one end of the lid member 15 in its transverse direction opposite to the end in which the support shaft 16 is provided. The engagement claws 27 of the blade receiving member 14 are selectively received in and removed from the corresponding recesses 31*a*. An engagement claw 32, which is arranged between the two recesses 31*a* and selectively engaged with and disengaged from the engagement shaft 28 of the blade receiving member 14, is also formed at the upper end of the frame body 30. The engagement claw 32 has a pressure receiving surface 33, which is the portion of the lid member 15 that is held in contact with the pressing portion 8 of the manipulation member 6.

The engagement recesses 12 of the holder head portion 3 and the engagement claws 27 of the blade receiving member 14, which become selectively engaged with and disengaged from the engagement recesses 12, configure a first locking mechanism, which releasably locks the blade receiving member 14 with respect to the holder head portion 3. The first locking mechanism prevents the razor head 13 from pivoting by locking the blade receiving member 14 with respect to the holder head portion 3.

The engagement shaft 28 of the blade receiving member 14 and the engagement claw 32 of the lid member 15, which becomes selectively engaged with and disengaged from the engagement shaft 28, configure a second locking mechanism, which releasably locks the lid member 15 with respect to the blade receiving member 14. When the second locking mechanism locks the lid member 15 with respect to the blade receiving member 14, the lid member 15 holds the blade assembly 17 placed on the blade receiving member 14 to the blade receiving member 14.

With reference to FIG. 4B, each blade 21 has a cutting edge 21*a* and the cutting edge 21*a* faces the common pivot axis 16*a* of the blade receiving member 14 and the lid member 15. The first locking mechanism and the second locking mechanism both face the portions of the blades 21 opposite to the cutting edges 21*a*.

The dimension of the razor head 13 in the left-and-right direction, which is the direction in which each cutting edge 21*a* extends, may be set to, for example, approximately 40 mm. It is preferable to set this dimension to approximately 5 mm to 70 mm.

The replacement blade razor may be kept non-pivotable as illustrated in FIGS. 1A to 2A. In this state, the engagement claws 27 of the blade receiving member 14 located on the holder head portion 3 are engaged with the corresponding engagement recesses 12 of the holder head portion 3, which locks the blade receiving member 14 with respect to the holder head portion 3. The engagement claw 32 of the lid member 15 is engaged with the engagement shaft 28 of the blade receiving member 14, which locks the lid member 15 with respect to the blade receiving member 14. Accordingly, the razor head 13 is prevented from pivoting with the lid member 15 continuously holding the blade assembly 17 placed on the blade receiving member 14 to the blade receiving member 14. The blades 21 of the blade assembly 17, which are arranged between the blade receiving member 14 and the lid member 15, are exposed to the exterior through the window hole 30*a* of the lid member 15. The manipulation member 6 in the hollow space 4 of the holder 1 is urged toward the bottom 4*b* of the hollow space 4 by the spring 10. The pressing portion 8 of the manipulation member 6 is located at a retreat position at which the pressing portion 8 does not apply pressure onto the pressure receiving surface 33 of the lid member 15. This maintains the lid member 15 locked to the blade receiving member 14. At this stage, the pusher 7 in the hollow space 4 is urged toward the opening 4*a* of the hollow space 4 by the spring 10. The pressing portion 9 of the pusher 7 is thus held in contact with the pressure receiving surface 29 of the blade receiving member 14. However, since the pressing portion 8 of the manipulation member 6 is located at the retreat position, the blade receiving member 14 is prevented from released from the holder head portion 3. In other words, in this state, the manipulation member 6 is located at such a position that the blade receiving member 14 is maintained locked to the holder head portion 3 and the lid member 15 is maintained locked to the blade receiving member 14. In the non-pivotable state shown in FIGS. 1A to 2A, the distance between each permanent magnet 11 and the corrugated plate portion 22 of the blade assembly 17 is set to approximately 1.2 mm so that the permanent magnets 11 arranged on the holder head portion 3 attract the blade assembly 17 by a sufficient intensity through magnetic force. The distance may be changed in correspondence with the intensity of the magnetic force of the permanent magnets 11.

In the non-pivotable state illustrated in FIGS. 1A to 2A, when the knob 6*a* is pressed upward against the urging of the spring 10 in order to manipulate the manipulation member 6, the pressing portion 9 of the pusher 7 cooperates with the manipulation member 6 and becomes projected from the opening 4*a* of the hollow space 4, thus applying pressure onto the pressure receiving surface 29 of the blade receiving member 14. This separates the engagement claws 27 of the blade receiving member 14 from the corresponding engagement recesses 12 of the holder head portion 3. The blade receiving member 14 is thus released from the holder head portion 3. In other words, in this state, the manipulation member 6 is located at such a position that the blade receiving member 14 is released from the holder head portion 3 and that the lid member 15 is maintained locked to the blade receiving member 14. Afterwards, when the knob 6*a* of the manipulation member 6 is released, the spring 10 urges the manipulation member 6 to return toward the bottom 4*b* of the hollow space 4. The pressing portion 8 of the manipulation member 6 thus becomes separate from the razor head 13. As a result, the razor is in a pivotable state illustrated in FIGS. 3A and 3B. In the pivotable state, the razor head 13 is pivotable, or swingable, in a predetermined angular range (for example, 0 to 45 degrees) about the pivot axis 16*a* while receiving pressure from the pusher 7. The distance between each permanent magnet 11 of the holder head portion 3 and the blade assembly 17 of the razor head 13 changes in correspondence with the angle by which the razor head 13 is pivoted. That is, the razor head 13 pivots in such a manner that the blade assembly 17 selectively approaches and separates from the permanent magnets 11. This changes the intensity of attraction of the blade assembly 17 to the permanent magnets 11 by the magnetic force. Specifically, as the pivot angle of the razor head 13 becomes greater, or, in other words, as the razor head 13 becomes more separate from the holder head portion 3, the intensity of attraction of the blade assembly 17 to the permanent magnets 11 by the magnetic force of the permanent magnets 11 becomes smaller. When the razor head 13 is pivoted by a maximum angle as illustrated in FIGS. 3A and 3B, the blade assembly 17 is prevented from being attracted to the permanent magnets 11 by the magnetic force.

Figures 3A, 3B, 3C:
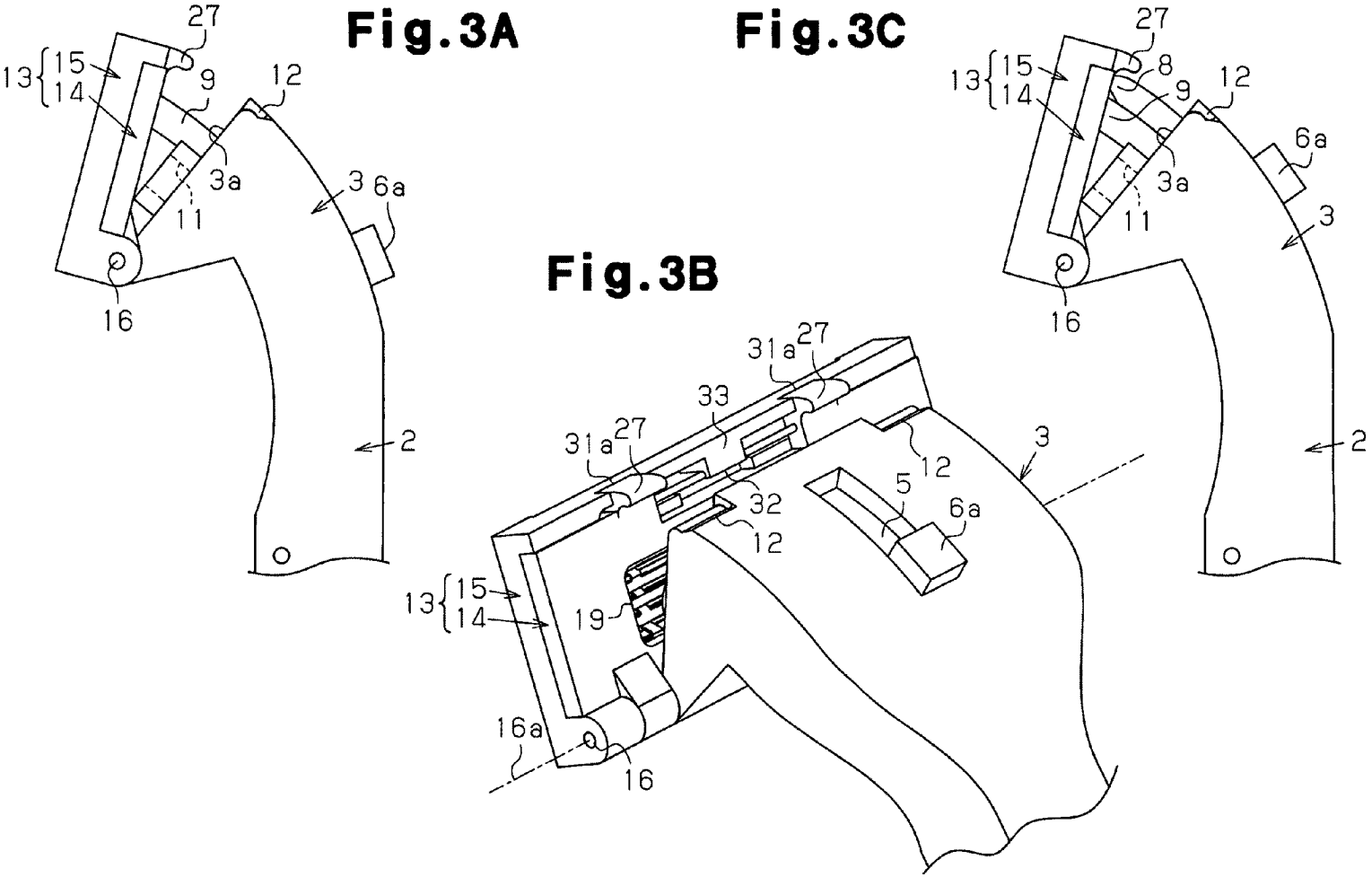
FIG. 3A is a side view showing a portion of the razor illustrated in FIGS. 1A to 2A in a pivotable state.
FIG. 3B is a perspective view showing a portion of the razor illustrated in FIGS. 1A to 2A in the pivotable state.
FIG. 3C is a side view showing a portion of the razor illustrated in FIGS. 1A to 2A in a transient state from the pivotable state to a blade assembly replaceable state.

In the pivotable state shown in FIGS. 3A and 3B, when the knob 6*a* of the manipulation member 6 is pressed upward against the urging of the spring 10 in order to re-manipulate the manipulation member 6, the pressing portion 8 of the manipulation member 6, as illustrated in FIG. 3C, becomes projected from the opening 4*a* of the hollow space 4, thus applying pressure onto the pressure receiving surface 33 of the lid member 15. This separates the engagement claw 32 of the lid member 15 from the engagement shaft 28 of the blade receiving member 14. The lid member 15 is thus released from the blade receiving member 14. In other words, in this state, the manipulation member 6 is located at such a position that the blade receiving member 14 is maintained released from the holder head portion 3 and the lid member 15 is released from the blade receiving member 14. Afterwards, when the knob 6*a* of the manipulation member 6 is released, the spring 10 urges the manipulation member 6 to return toward the bottom 4*b* of the hollow space 4, thus separating the pressing portion 8 of the manipulation member 6 from the razor head 13. As a result, the razor is in a blade assembly replaceable state illustrated in FIGS. 4A and 4B. In other words, in this state, the manipulation member 6 is located at such a position that the blade receiving member 14 is maintained released from the holder head portion 3 and the lid member 15 is maintained released from the blade receiving member 14. In the blade assembly replaceable state, the lid member 15 is pivoted about the pivot axis 16*a* and thus separated from the top of the blade receiving member 14. This allows the blade assembly 17 to be separated and removed from the blade receiving member 14 without being touched directly by hand (see FIG. 4C).

Figure 6A:
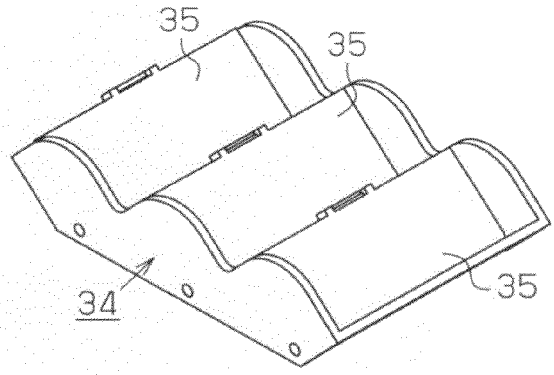
FIGS. 6A and 6B are perspective views showing a replacement blade case in which replacement blade assemblies for the razor illustrated in FIGS. 1A to 2A is accommodated.
Figure 6B:
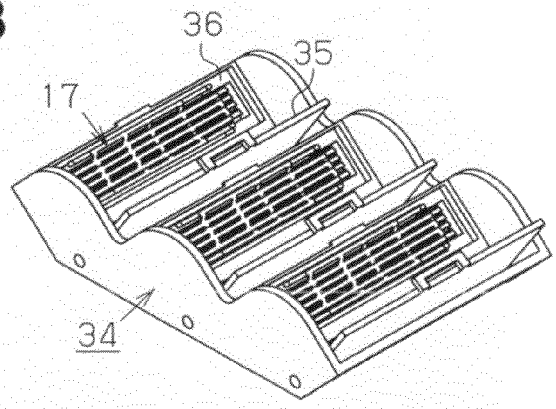

FIGS. 6A and 6B show a replacement blade case 34, which accommodates replacement blade assemblies 17. The replacement blade case 34 includes a plurality of accommodation chambers 36, each of which is covered by a lid body 35 that is supported in a pivotable manner. Each of the accommodation chambers 36 receives a replacement blade assembly 17. Each blade assembly 17 is oriented in the corresponding accommodation chamber 36 in such a manner that the leg portions 23 face the opening of the accommodation chamber 36.

Figure 8A:
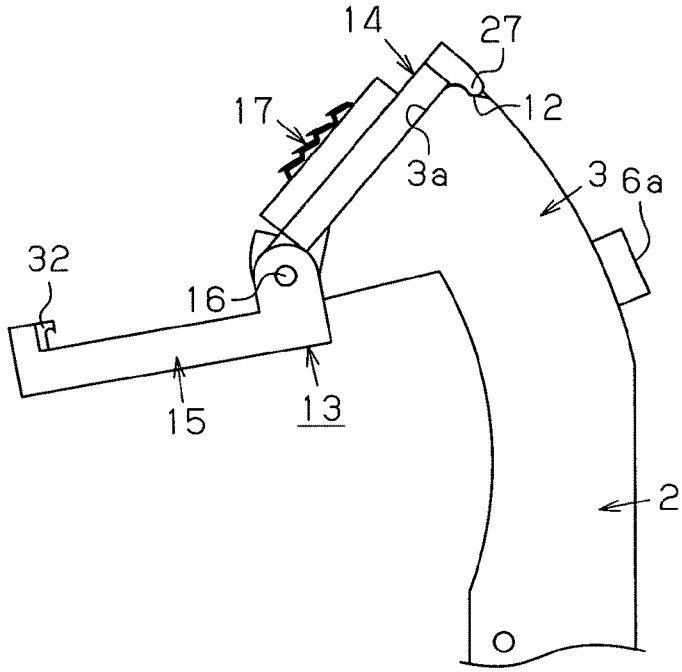
FIG. 8A and FIG. 8B are a side view and a perspective view, each showing a portion of the razor illustrated in FIGS.
Figure 8B:
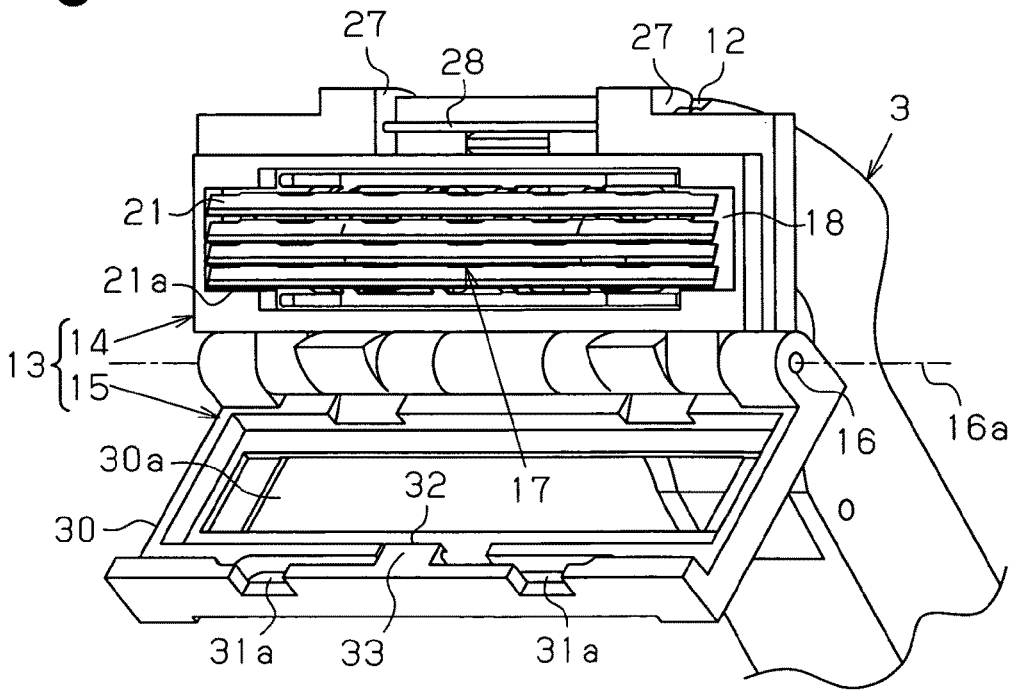

After the blade assembly 17 is removed, the blade receiving member 14 of the razor head 13 is brought into contact with the walls of the corresponding accommodation chamber 36 of the replacement blade case 34 as illustrated in FIG. 7A, in such a manner that the blade receiving member 14 faces the replacement blade assembly 17 received in the accommodation chamber 36. At this stage, the distance between each permanent magnet 11 of the holder head portion 3 and the replacement blade assembly 17 accommodated in the accommodation chamber 36 is comparatively great. This generates insufficient attraction of the replacement blade assembly 17 to the permanent magnets 11 by the magnetic force. Accordingly, as illustrated in FIG. 7B, the holder head portion 3 is pivoted about the pivot axis 16*a* in such a manner as to press the pusher 7 into the hollow space 4 of the holder 1 against the urging of the spring 10. This engages the engagement claws 27 of the blade receiving member 14 with the corresponding engagement recesses 12 of the holder head portion 3. The blade receiving member 14 thus becomes overlapped with and locked to the holder head portion 3. The replacement blade assembly 17 is thus attracted to the permanent magnets 11 arranged on the holder head portion 3 by the magnetic force and placed on the blade receiving member 14. As a result, as illustrated in FIGS. 8A and 8B, the blade assembly 17 can be removed from the accommodation chamber 36 of the replacement blade case 34, while mounted in the blade receiving member 14. Afterwards, by pivoting the lid member 15 about the pivot axis 16*a* to engage the engagement claw 32 of the lid member 15 with the engagement shaft 28 of the blade receiving member 14, the lid member 15 is locked to the blade receiving member 14. The razor is thus returned to the non-pivotable state illustrated in FIGS. 1A to 2A. In this manner, the mounting of the replacement blade assembly 17 in the razor head 13 is accomplished.

In the modification illustrated in FIG. 2B, an adhesive tape 37, instead of the permanent magnets 11, is arranged in the holder head portion 3. In this modification, the adhesive tape 37 functions as a holding mechanism that assists in mounting of the blade assembly 17 in the razor head 13 by adhering to the blade assembly 17 and causing the razor head 13 to hold the blade assembly 17. When the blade assembly 17 is fitted in the recess 18 of the blade receiving member 14, the blade assembly 17 is adhered to the adhesive tape 37 at the leaf springs 25 of the leg portions 23.

A second embodiment of the present invention will now be described with reference to FIGS. 9A to 11C, mainly on the differences between the second embodiment and the first embodiment.

FIGS. 9A and 9B show a replacement blade case 38, which accommodates replacement blade assemblies 17, used in the second embodiment, instead of the replacement blade case 34 illustrated in FIGS. 6A and 6B. The replacement blade case 38 has a plurality of accommodation chambers 40 covered by a common lid body 39. As shown in FIG. 10A, each of the accommodation chambers 40 accommodates a replacement blade assembly 17. The leg portions 23 of each replacement blade assembly 17 in the corresponding accommodation chamber 40 are located at the bottom.

FIG. 9C illustrates a loading member 41, which is used for mounting the replacement blade assembly 17 received in the replacement blade case 38 in the razor head 13. The loading member 41 has two elastic arm portions 43, which extend from a U-shaped handle 42 and are spaced apart. Distal ends of the arm portions 43 are connected together. Engagement projections 44 are each formed in the vicinity of the longitudinal center of the corresponding arm portion 43. As illustrated in FIG. 10A, the arm portions 43 of the loading member 41 are inserted into one of the accommodation chambers 40 of the replacement blade case 38. The engagement projections 44 of the arm portions 43 are thus brought into contact with the corresponding leg portions 23 of the replacement blade assembly 17. Alternatively, the handle 42 may be pressed from both sides. In these manners, the arm portions 43 flexibly deform and the engagement projections 44 of the arm portions 43 become engaged with the engagement holes 26 of the corresponding leg portions 23 of the replacement blade assembly 17. Accordingly, as illustrated in FIG. 10B, by removing the loading member 41 from the accommodation chamber 40, the replacement blade assembly 17 is separated from the accommodation chamber 40 in a state held by the arm portions 43. Then, as illustrated in FIG. 11A, the loading member 41 is brought into contact with the razor head 13 with the replacement blade assembly 17 held by the loading member 41. In other words, the lid member 15 of the razor head 13 is opened and the replacement blade assembly 17, which is held by the loading member 41, is mounted in the recess 18 of the blade receiving member 14. The lid member 15 is then closed as shown in FIG. 11B and the loading member 41 is removed from the razor head 13 by pulling the handle 42 of the loading member 41, which projects from a side hole 45 formed between the blade receiving member 14 and the lid member 15. This flexibly deforms the arm portions 43 of the loading member 41, thus disengaging the engagement projections 44 of the arm portions 43 from the engagement holes 26 of the corresponding leg portions 23 of the replacement blade assembly 17. This releases the replacement blade assembly 17, which has been held by the loading member 41, from the loading member 41. Then, with reference to FIG. 11C, the loading member 41 is removed from the razor head 13 with the released replacement blade assembly 17 remaining in the razor head 13, or in other words, between the blade receiving member 14 and the lid member 15. In this manner, the replacement blade assembly 17 is transferred from the loading member 41 to the razor head 13. The engagement projections 44 of the loading member 41 and the engagement holes 26 of the replacement blade assembly 17 configure an attaching/detaching mechanism that can be in a state in which the replacement blade assembly 17 is held by the loading member 41 and a state in which the replacement blade assembly 17, which is held by the loading member 41, is allowed to separate from the loading member 41.

Main advantages of the first and second embodiments and the modification of the first embodiment will hereafter be described.

With the razor of the first embodiment, a blade assembly 17, which is accommodated in the replacement blade case 34 illustrated in FIGS. 6A and 6B, can be mounted in the razor head 13 using the magnetic force generated by the permanent magnets 11, which are arranged in the holder head portion 3, without touching the blade assembly 17 directly by hand. The permanent magnets 11 function as a magnetic force generating portion that generates magnetic force. The permanent magnets 11 function also as a holding mechanism that assists in mounting of the blade assembly 17 in the razor head 13 by attracting the blade assembly 17 by the magnetic force and causing the razor head 13 to hold the blade assembly 17.

With the razor of the first embodiment, by pivoting the razor head 13 with the lid member 15 in an open state, the blade assembly 17 mounted in the razor head 13 can be separated and removed from the blade receiving member 14 without being touched directly by hand. After having been separated, the blade assembly 17 may be returned to the replacement blade case 34 illustrated in FIGS. 6A and 6B or to the replacement blade case 38 illustrated in FIGS. 9A and 9B. Alternatively, the blade assembly 17 may be simply discarded.

With the razor of the modification of the first embodiment, which is illustrated in FIG. 2B, the blade assembly 17 accommodated in the replacement blade case 34 illustrated in FIGS. 6A and 6B can be mounted in the razor head 13 using the adhesion force generated by the adhesive tape 37 arranged in the holder head portion 3 without being touched directly by hand. The adhesive tape 37 functions as a holding mechanism that assists in mounting of the blade assembly 17 in the razor head 13 by adhering to the blade assembly 17 and causing the razor head 13 to hold the blade assembly 17.

In the razor of the second embodiment, the blade assembly 17 accommodated in the replacement blade case 38 illustrated in FIGS. 9A and 9B can be mounted in the razor head 13 using the loading member 41 without being touched directly by hand.

In the razor of the first embodiment, the blade assembly 17 is replaced independently with the lid member 15 of the razor head 13 in an open state. After the blade assembly 17 is replaced, the components other than the used blade assembly 17 are continuously usable.

The first and second embodiments and the modification of the first embodiment may be modified to the following forms.

The permanent magnets 11 may be omitted from the razor of the second embodiment.

The permanent magnets 11 may be replaced by electromagnets in the razor of the first embodiment. In this case, the electromagnets function as the magnetic force generating portion and the holding mechanism.

The permanent magnets 11 of the razor of the first embodiment may be replaced by a holding mechanism that assists in mounting of the blade assembly 17 in the razor head 13 by attracting the blade assembly 17 by electric force or, particularly, electrostatic force instead of the magnetic force, and causing the razor head 13 to hold the blade assembly 17. An electric force generating portion for generating the electric force or, particularly, the electrostatic force is arranged, for example, in the holder head portion 3.

The permanent magnets 11 of the razor of the first embodiment may be replaced by a holding mechanism that assists in mounting of the blade assembly 17 in the razor head 13 by causing the razor head 13 to hold the blade assembly 17 through suction (attraction) by air instead of the magnetic force. An air suction portion, which performs the suction by air, is arranged, for example, in the holder head portion 3.

In the first and second embodiments, by manipulating the manipulation member 6, the razor is switched from the non-pivotable state to the pivotable state and from the pivotable state to the blade assembly replaceable state. However, the razor may be configured in such a manner that the razor is switched directly from the non-pivotable state to the blade assembly replaceable state. In this case, a manipulation member for switching the razor from the non-pivotable state to the blade assembly replaceable state may be provided independently from the manipulation member 6.

The through holes 19 may be omitted from the blade receiving member 14. In this case, it is preferable to form the bottom of the recess 18 using a material permitting transmission of magnetic field lines.

An engagement claw may be formed in the holder head portion 3 instead of the engagement recess 12. In this case, an engagement recess that becomes selectively engaged with and disengaged from the engagement claw is formed in the blade receiving member 14 instead of the engagement claw 27.

An engagement claw may be formed in the blade receiving member 14 instead of the engagement shaft 28. In this case, an engagement shaft that becomes selectively engaged with and disengaged from the engagement shaft is formed in the lid member 15 instead of the engagement claw 32.

Instead of forming the engagement recess 12 and the engagement claw 27 in the holder head portion 3 and the blade receiving member 14, respectively, mutually attracting permanent magnets may be arranged in both of the holder head portion 3 and the blade receiving member 14.

Instead of forming the engagement shaft 28 and the engagement claw 32 in the blade receiving member 14 and the lid member 15, respectively, mutually attracting permanent magnets may be arranged in both of the blade receiving member 14 and the lid member 15.

The permanent magnets 11 of the razor of the first embodiment may be arranged in the razor head 13, that is, in the blade receiving member 14 or the lid member 15, instead of in the holder head portion 3. In the razor of the modification of the first embodiment illustrated in FIG. 2B, the adhesive tape 37 may be arranged in the razor head 13, that is, in the blade receiving member 14 or the lid member 15, instead of in the holder head portion 3.

The blade receiving member 14 and the lid member 15 of the razor head 13 do not necessarily have to pivot about the common support shaft 16 but may pivot about separate pivot axes.

The number of the blades 21 provided in each blade assembly 17 may be any suitable number other than four. Alternatively, the blade assembly 17 may be replaced by a blade member configured by a single blade.

The components of the razor and the replacement blade cases 34, 38 do not necessarily have to be formed of metal but may be formed of resin, except for the blade assembly 17.

If the lid member 15 is formed of metal, the surface of the lid member 15 may be coated with fluorine contained resin or silicone resin.

If the lid member 15 is formed of resin, an appropriate amount of fluorine contained resin or silicone oil may be added to the resin.

The razor head 13, the holder 1, and the replacement blade cases 34, 38 may be formed transparently of transparent resin so that the internal configurations of these components are readily visible from outside.

A shaving aid may be formed on a portion of the surface of the lid member 15 located around the blade assembly 17. An appropriate amount of tourmaline or shea butter or coal element may be added to the shaving aid.

In order to facilitate determination whether the blade assembly 17 has been used, the lid member 15 may include, for example, stamp means. When the lid member 15 is closed with the blade assembly 17 placed on the blade receiving member 14, the stamp means stamps on the blade assembly 17. Alternatively, a portion of the blade assembly 17 may be deformed or damaged by closing the lid member 15 with the blade assembly 17 placed on the blade receiving member 14.

The invention claimed is:

1. A replacement blade razor comprising:

a holder having a head portion;

a razor head supported by the head portion of the holder;

a blade member removably mounted in the razor head; and a pivot mechanism mounted in the head portion and configured to allow the razor head to pivot with respect to the head portion, wherein the head portion of the holder includes a magnetic force generating portion that assists in mounting of the blade member in the razor head by attracting the blade member using magnetic force, thus causing the head portion to hold the blade member, and wherein the razor head is configured to pivot via the pivot mechanism such that the blade member can selectively approach or separate from the magnetic force generating portion when the blade member is mounted in the razor head.

2. The razor according to claim 1, wherein the magnetic force generating portion is arranged in the head portion of the holder to face the blade member mounted in the razor head.

3. The razor according to claim 2, wherein an intensity of attraction of the blade member toward the magnetic force generating portion by the magnetic force is variable.

4. The razor according to claim 3, wherein the intensity of the attraction is varied by changing a distance between the blade member mounted in the razor head and the magnetic force generating portion.

5. The razor according to claim 4, wherein the distance between the blade member and the magnetic force generating portion is changed by pivoting the razor head, using the pivot mechanism, in such a manner that the blade member selectively approaches and separates from the magnetic force generating portion.

6. The razor according to claim 1, wherein the magnetic force generating portion is a magnet generating the magnetic force.

7. The razor according to claim 1, wherein the holder includes the head portion and an elongated holding portion.

8. A replacement blade razor comprising:

a holder having a head portion;

a razor head supported by the head portion of the holder;

a blade member removably mounted in the razor head;

a blade receiving member mounted in the razor head;

a lid member mounted in the razor head and supported by the blade receiving member; and a pivot mechanism mounted in the head portion and configured to allow the razor head, the blade receiving member, and the lid member to pivot with respect to the head portion, wherein the blade member is mounted in the razor head by being placed on the blade receiving member and held in place by the lid member, wherein the razor head can be arranged into a first state, in which the lid member and the blade receiving member are secured to each other, and the lid member and the blade receiving member are allowed to pivot integrally via the pivot mechanism with respect to the head portion, and wherein the razor head can be arranged into a second state, in which the lid member is allowed to pivot separately from the blade receiving member via the pivot mechanism with respect to the head portion, and wherein the blade member can be removed from the razor head in the second state, when the lid member pivots separately from the blade receiving member.

9. The razor according to claim 8, wherein the replacement blade razor further comprises:

a manipulation member arranged in the holder and configured to be manipulated to switch the razor head from the first state to the second state; and a locking mechanism arranged in the razor head between the blade receiving member and the lid member, and configured to releasably lock the lid member to the blade receiving member, wherein, when the lid member is locked to the blade receiving member by the locking mechanism, the blade member placed on the blade receiving member is held in the blade receiving member by the lid member, and wherein the manipulation member is configured to press against the lid member to release the locking mechanism, thereby unlocking the lid member from the blade receiving member.

10. The razor according to claim 8, wherein the razor head is allowed to pivot by pivotably supporting the blade receiving member in the head portion of the holder.

11. The razor according to claim 10, wherein the blade receiving member and the lid member pivot about a common pivot axis.

12. The razor according to claim 11, wherein the blade member has a cutting edge, and wherein the pivot axis faces the cutting edge, while the locking mechanism faces a portion of the blade member opposite to the cutting edge.

13. The razor according to claim 8, wherein the holder includes a pusher, and the razor head pivots while receiving pressure from the pusher.

14. The razor according to claim 8, wherein a magnet is provided in the head portion of the holder, wherein the magnet attracts the blade member mounted on the blade receiving member by a magnetic force and thus assists the blade receiving member in holding the blade member, and wherein, when the razor head is in the second state, the blade member can be stopped being attracted to the magnet by the magnetic force.

15. The razor according to claim 14, wherein a through hole is formed in a portion of the blade receiving member that faces the magnet, the blade member being attracted to the magnet through the through hole.

16. The razor according to claim 14, wherein when the razor head is in the second state, and when the blade member has been removed, the blade receiving member is configured such that it can face a replacement blade member accommodated in a replacement blade case, and, wherein the magnet is configured to assist the replacement blade member in being placed on the blade receiving member, when the blade receiving member is arranged to face the replacement blade member.

17. The razor according to claim 8, wherein the holder includes the head portion and an elongated holding portion.

18. A replacement blade razor comprising:

a holder having a head portion;

a razor head supported by the head portion of the holder;

a blade member removably mounted in the razor head;

a blade receiving member arranged in the razor head;

a lid member arranged in the razor head and supported by the blade receiving member; and a pivot mechanism mounted in the head portion and configured to allow the razor head, the blade receiving member, and the lid member to pivot with respect to the head portion, wherein the blade member is mounted in the razor head while being placed on the blade receiving member and held, in this state, by the lid member, wherein the razor head can be arranged into a first state, in which the lid member and the blade receiving member are secured to each other, together holding the blade member, and the lid member and the blade receiving member are allowed to pivot integrally via the pivot mechanism with respect to the head portion, wherein the razor head can be arranged in a second state, in which the lid member and the blade receiving member are secured to each other, together holding the blade member, and the lid member and the blade receiving member are prevented from pivoting via the pivot mechanism with respect to the head portion, wherein the razor head can be arranged into a third state, in which the lid member is allowed to pivot separately from the blade receiving member via the pivot mechanism with respect to the head portion, and wherein the blade member can be removed in the third state, when the lid member pivots separately from the blade receiving member.

19. The razor according to claim 18, wherein the holder includes a manipulation member, the manipulation member being configured in such a manner as to be manipulated to switch the razor head from the second state to the first state and from the first state to the third state, or to switch the razor head from the second state to the first state and from the second state to the third state, wherein a first locking mechanism that releasably locks the blade receiving member to the head portion of the holder is arranged between the head portion of the holder and the blade receiving member, wherein the razor head is prevented from pivoting when the first locking mechanism locks the blade receiving member to the head portion of the holder, wherein a second locking mechanism that releasably locks the lid member to the blade receiving member is arranged between the blade receiving member and the lid member, and wherein the blade member placed on the blade receiving member is held in the blade receiving member by the lid member when the second locking mechanism locks the lid member to the blade receiving member.

20. The razor according to claim 19, wherein the manipulation member is configured in such a manner as to be switched between:

a position at which the manipulation member maintains both of the locking of the blade receiving member by the first locking mechanism to the head portion of the holder and the locking of the lid member by the second locking mechanism to the blade receiving member;

a position at which the manipulation member maintains the locking of the lid member by the second locking mechanism to the blade receiving member, while canceling the locking of the blade receiving member by the first locking mechanism to the head portion of the holder;

a position at which the manipulation member maintains a state in which the locking of the blade receiving member by the first locking mechanism to the head portion of the holder is canceled, while canceling the locking of the lid member by the second locking mechanism to the blade receiving member; and a position at which the manipulation member maintains a state in which the locking of the blade receiving member by the first locking mechanism to the head portion of the holder and the locking of the lid member by the second locking mechanism to the blade receiving member are both cancelled.

21. The razor according to claim 19, wherein the razor head is allowed to pivot by pivotably supporting the blade receiving member in the head portion of the holder.

22. The razor according to claim 21, wherein the blade receiving member and the lid member pivot about a common pivot axis.

23. The razor according to claim 22, wherein the blade member has a cutting edge, and wherein the pivot axis faces the cutting edge, while the first and second locking mechanisms face a portion of the blade member opposite to the cutting edge.

24. The razor according to claim 18, wherein the holder has a pusher, and the razor head pivots while receiving pressure from the pusher.

25. The razor according to claim 18, wherein a magnet is provided in the head portion of the holder, wherein the magnet attracts the blade member mounted on the blade receiving member by a magnetic force and thus assists the blade receiving member in holding the blade member, and wherein, when the razor head is in the third state, the blade member can be stopped being attracted to the magnet.

26. The razor according to claim 25, wherein a through hole is formed in a portion of the blade receiving member that faces the magnet, the blade member being attracted to the magnet through the through hole.

27. The razor according to claim 25, wherein when the razor head is in the third state, and when the blade member has been removed, the blade receiving member is configured such that it can face a replacement blade member accommodated in a replacement blade case, and wherein the magnet is configured to assist the replacement blade member in being placed on the blade receiving member, when the blade receiving member is arranged to face the replacement blade member.

28. The razor according to claim 18, wherein the holder includes the head portion and an elongated holding portion.

* * * * *